US007637383B2

(12) United States Patent
Schlumpf

(10) Patent No.: US 7,637,383 B2
(45) Date of Patent: Dec. 29, 2009

(54) NIPPLE FOR DRINKING VESSELS, ESPECIALLY BABY BOTTLES

(75) Inventor: Ulrich Schlumpf, Regensdorf (CH)

(73) Assignee: Lamprecht AG, Regensdorf (CH)

( * ) Notice: Subject to any disclaimer, the term of this patent is extended or adjusted under 35 U.S.C. 154(b) by 256 days.

(21) Appl. No.: 11/329,392

(22) Filed: Jan. 11, 2006

(65) Prior Publication Data

US 2006/0175278 A1 Aug. 10, 2006

(30) Foreign Application Priority Data

Jan. 13, 2005 (EP) ..... 05405021
Jan. 3, 2006 (EP) ..... 06100050

(51) Int. Cl.
*A61J 11/00* (2006.01)

(52) U.S. Cl. ..... 215/11.1

(58) Field of Classification Search ..... 215/11.1, 215/11.4, 11.5
See application file for complete search history.

(56) References Cited

U.S. PATENT DOCUMENTS 1,122,868 A * 12/1914 Davis ..... 222/490
2,223,179 A * 11/1940 Lougheed ..... 215/11.1
2,805,663 A * 9/1957 Robinson et al. ..... 215/11.1
2,812,764 A * 11/1957 Crisp ..... 215/11.1
3,113,569 A * 12/1963 Barr et al. ..... 215/11.1
3,139,064 A * 6/1964 Harle ..... 116/309
3,532,242 A * 10/1970 Tibbs ..... 215/11.1
3,669,323 A * 6/1972 Harker et al. ..... 222/490
4,726,376 A * 2/1988 Dahan ..... 606/234
D294,735 S * 3/1988 Morano et al. ..... D24/196
4,993,568 A 2/1991 Morifuji et al.
5,101,991 A * 4/1992 Morifuji et al. ..... 215/11.1
D330,938 S * 11/1992 Sakashita ..... D24/196
5,439,143 A * 8/1995 Brown et al. ..... 222/185.1
5,769,285 A * 6/1998 Upham et al. ..... 222/481.5
5,784,999 A * 7/1998 Larson et al. ..... 119/71
2004/0124168 A1* 7/2004 Silver ..... 215/11.1
2004/0144743 A1* 7/2004 Holley, Jr. ..... 215/11.1
2004/0164043 A1* 8/2004 Hakim ..... 215/11.5
2004/0195253 A1* 10/2004 Boucher et al. ..... 220/714

FOREIGN PATENT DOCUMENTS

EP 0459079 A1 * 1/1991
EP 0496892 A1 * 8/1992
EP 0753294 A1 * 1/1997
FR 2833829 A1 * 6/2003
GB 2066795 A * 7/1981

* cited by examiner

*Primary Examiner*—Sue A Weaver
(74) *Attorney, Agent, or Firm*—Shoemaker and Mattare

(57) ABSTRACT

A nipple for baby bottles has a flattened nipple element with a recess which is pointed to the inside in its front end. In the bottom section of the recess there is a slit arrangement with arc-shaped slits which run in the bite direction.

17 Claims, 6 Drawing Sheets

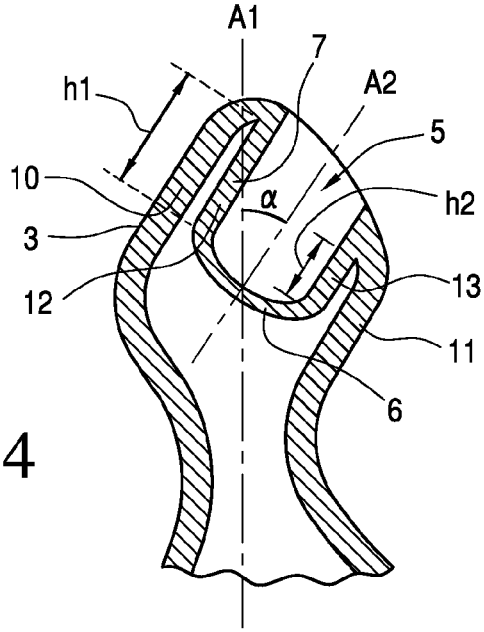
FIG. 4
FIG. 5a
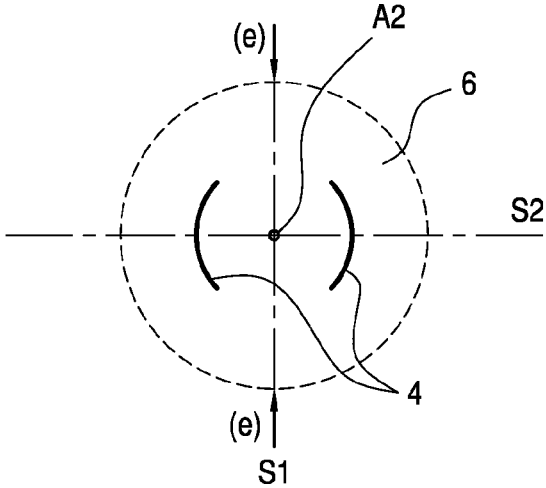
FIG. 5b
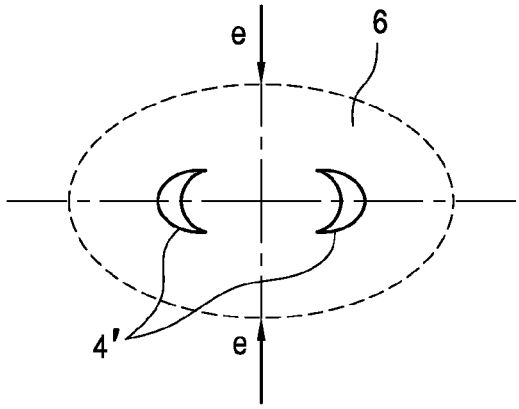

NIPPLE FOR DRINKING VESSELS, ESPECIALLY BABY BOTTLES

BACKGROUND OF THE INVENTION

The invention relates to a nipple for drinking vessels, especially for baby bottles. These nipples consist of an elastic material, for example rubber or silicone, and can be attached to baby bottles or other drinking vessels. Preferably these nipples are used for feeding infants or small children.

Generically comparable nipples have been known for a long time. Thus, for example U.S. Pat. No. 4,993,568 describes a nipple with a separating membrane which has an I-, X- or Y-shaped cut. Pressure on the separating membrane yields a milk sucking hole. U.S. Pat. No. 4,993,568 furthermore shows that the separating membrane is located in an inwardly pointed recess in the area of the front end of the nipple. This also results in the baby bottle or the nipple's not leaking (so-called "no spill" property). When the nipple is not suitably positioned in the mouth of the infant, emergence of liquid during drinking can be insufficient. Furthermore, especially in nipples with X- or Y-shaped notches it has been found that the nipple no longer meets the higher and higher demands for no-spill properties or does so only with difficulty.

SUMMARY OF THE INVENTION

Therefore the object of this invention is to avoid the disadvantages of what is known, especially therefore to make available a nipple in which liquid passage is optimized. The nipple will furthermore be leakproof and have optimum no-spill properties.

These objects are achieved by a nipple which has the features described below.

Due to the flattened shape of the nipple element it can be advantageously held in the mouth of the infant or other user. Thus an orthodontic shape can be achieved. The arrangement furthermore ensures that the slit arrangement is optimally positioned. In particular, for feeding infants a nipple will be made preferably such that little or no liquid will emerge by sucking alone. The slit for the drinking process can be optimally opened under pressure in the bite direction to the flattened sides of the nipple element, for example by chewing-biting movements. Under pressure transversely to the bite direction for example a slit cannot be opened at all or barely so. Conversely, under pressure in the bite direction the arc-shaped slit can be opened such that sufficient liquid flow is achieved. Such a nipple is also characterized by good no-spill properties.

It is advantageous if the nipple element is tilted at an angle relative to the principal center line. In this way the handling of baby bottles which are equipped with these nipples can be improved. The tilted arrangement of the nipple element can also improve the pressure in the drinking process, especially in the area of the upper lip of an infant. Especially preferably the tilt angle which is formed by the principal center line and by the center line of the nipple and by which the nipple element is tilted is between 10° and 60°, preferably between 20° and 45°, and especially preferably roughly 30°. In this way an especially favorable ergonomic position can be assumed for feeding an infant.

The no-spill properties can be further enhanced if in the area of the front end of the nipple element there is a recess which is pointed to the inside and if the slit arrangement is located in the recess. Preferably the slit arrangement can be located in the bottom section of the recess. Of course the no-spill properties could also be enhanced in some other way, for example by making the wall comparatively thick, especially in the area of the slit arrangement. This arrangement can also withstand the internal pressure as a result of the column of liquid.

The recess can have a tubular segment which is sealed by a bottom section. On the side opposite the bottom section the tubular segment can adjoin an opening on the front end of the nipple element with an inside which can preferably be made cylindrical. The tubular segment preferably runs roughly in the direction of the center line of the nipple. Furthermore, the tubular segment can have a given wall thickness. Then the tubular segment can preferably be made circular. Of course however also other basic shapes are conceivable. Thus, for example polygonal or elliptical configurations are also possible.

The bottom section, depending on the application, can be either plane or can be arched concavely or convexly.

It can be advantageous if the nipple element is tilted at an angle relative to the principal center line and if the recess has a bottom section which is located essentially at a right angle to the center line of the nipple of the nipple element. Thus the bottom section can be advantageously arched under pressure in the bite direction to the nipple element, the slit opening into a drinking opening.

Alternatively the nipple element can also have a recess with a bottom section which is bent relative to the center line of the nipple such that there is a tilt angle between 30° and 85° and preferably between 60° and 80°. This oblique arrangement of the bottom section can act advantageously on the sealing action and also on the opening behavior of the slit arrangement. This oblique arrangement of the bottom section could of course also be suitable for conventional slit arrangements.

In one embodiment the nipple element, when it is tilted by an angle relative to the principal center line, can have a recess with a bottom section which runs roughly at a right angle ($\gamma$=90°) to the principal center line (FIG. 11).

The recess in the area of the front end of the nipple element can have a tubular segment which defined in cross section by the main plane of symmetry can be essentially a truncated hollow cylinder with a roughly constant wall thickness. The bottom section can have roughly the same wall thickness. One cut of the truncated hollow cylinder can be defined by the bottom section and the other cut can be defined by the opening on the front end of the nipple element. Tests with nipples have shown that a recess which is made in this way yields advantageous results not only for arc-shaped slits, but also for conventional slit arrangements. In particular, in this way the opening behavior of the slits under pressure as well as the no-spill properties can be optimized. Conventional slit arrangements (i.e. no arc-shaped slits) could have straight slits (for example, as an I cut). Of course they could also cross one another (for example X, Y).

The segment which is tubular as a truncated hollow cylinder defined in cross section by the main plane of symmetry can form a first, especially the longest jacket side, and an opposing second, especially the shortest jacket side. The height of the second jacket side can be less than 3 mm and preferably less than 1 mm. The ratio of the height of the first jacket side to the height of the second jacket side can be for example between 1.5 and 2.5. A tubular section which has been shortened in this way can furthermore benefit the opening behavior and the non-spill effect.

It can be especially advantageous if the tubular segment defined in cross section by the main plane of symmetry can have the first, especially the longest jacket side, and if the bottom section in the area of the side opposite the first jacket side is molded directly (or roughly without a transition) to the flattened top of the nipple element. The top can be defined as the flattened side of the nipple element for the upper jaw, for example of an infant. Thus an especially favorable transfer of force can be achieved under pressure. Here the bottom section can preferably arch to the inside, by which the liquid passage can take place. Another advantage of this embodiment is the comparatively long durability of the nipple due to the compact construction.

In another embodiment the slit arrangement has two slits. This paired arrangement of slits has the advantage that the drinking performance of the nipple is enhanced.

It is especially advantageous if the slits are arranged symmetrically to one another with reference to the main plane of symmetry of the nipple and are pointed at one another. The bite direction which is dictated by the flattened nipple element advantageously runs in the main plane of symmetry of the nipple. Of course the slits can be arranged mirror-inverted to one another such that they are pointed away from one another.

The slit can be roughly circular, especially semicircular. The respective center of the circle is preferably on the axis of symmetry which runs perpendicular to the main plane of symmetry. The center of the circular slit (arc) is preferably likewise on this axis of symmetry.

It is especially advantageous if the slits lie on a circle with a center which is defined by the center line of the nipple. In this way an especially durable nipple construction is formed.

The slit arrangement with reference to the main plane of symmetry can have at least two slits at a time which are located symmetrically to one another and are pointed at one another. The respective at least two slits can be arranged on concentric circles to form a louver-like structure. In this way the passage of liquid can be advantageously enhanced.

The slits can be made as notches without removal of material in one wall of the nipple element. Such a nipple can be produced easily and economically. At the same time optimum no-spill properties are be ensured.

The slit can run obliquely in cross section through one wall of the nipple element. The no-spill properties can be additionally enhanced by this lengthening of the slit in cross section.

Other individual features and advantages of the invention are apparent from the following description of embodiments and from the drawings.

BRIEF DESCRIPTION OF THE DRAWINGS

FIG. 4 shows a detailed representation of one cross section of the nipple element, FIG. 5*a*, 5*b* show a slit arrangement in the rest position and under pressure.

DESCRIPTION OF THE PREFERRED EMBODIMENTS

Figure 1:
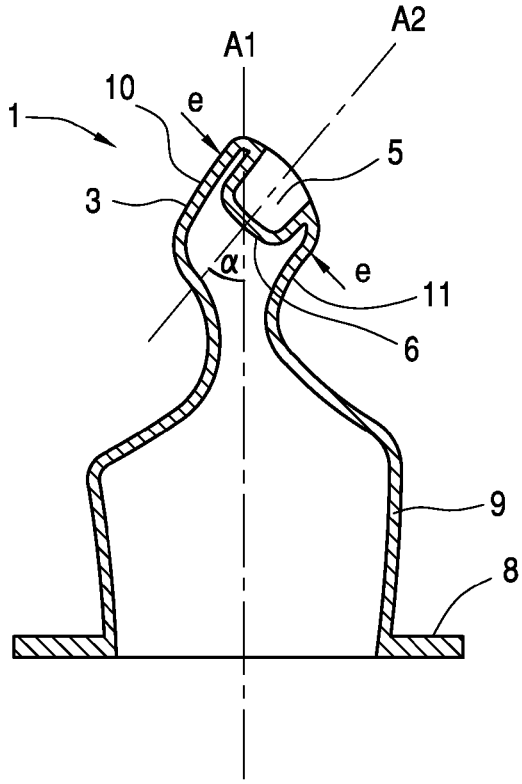
FIG. 1 shows a cross section through a nipple embodying the invention.

The nipple which is labeled 1 in FIG. 1 is shown in cross section through the main plane of symmetry. It consists essentially of a slightly funnel-shaped base body 9 and an adjoining nipple element 3 which is intended to be held in the mouth of the infant. Between the base body 9 and the nipple element 3 the nipple is tapered. The lips of the infant can be placed on this taper.

In the area of the front end of the nipple element 3 there is a recess 5, there being a slit arrangement in the bottom section 6 of the recess 5. Obviously the nipple element 3 is tilted by an angle designated $\alpha$ with reference to the principal center line A1. The bottom section 6 with the slit arrangement runs at a right angle to the center line A2. The nipple 1 consists of an elastic material, for example rubber, silicone, or another material.

The nipple 1 furthermore has a flange section 8 for connection to a baby bottle (not shown). Advantageously using a clamp ring which can be screwed onto the baby bottle a nipple can be attached to the latter. Of course the flange section 8 could be equipped with at least one air valve.

Figure 2:
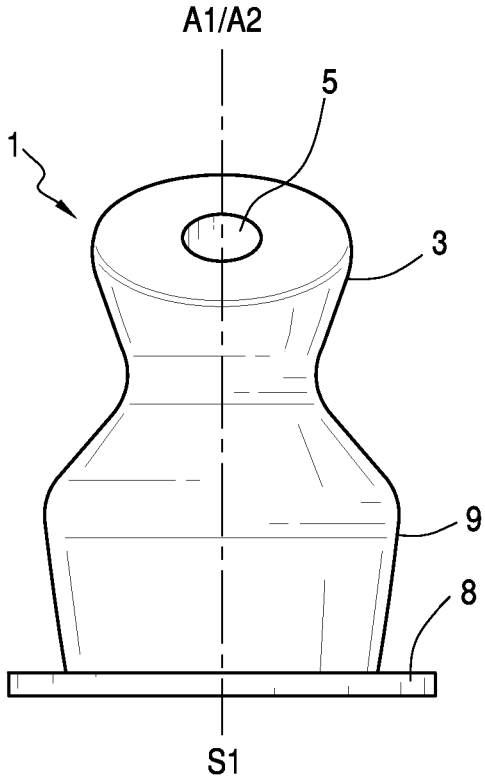
FIG. 2 shows a front view of the nipple as shown in FIG. 1.
Figure 3:
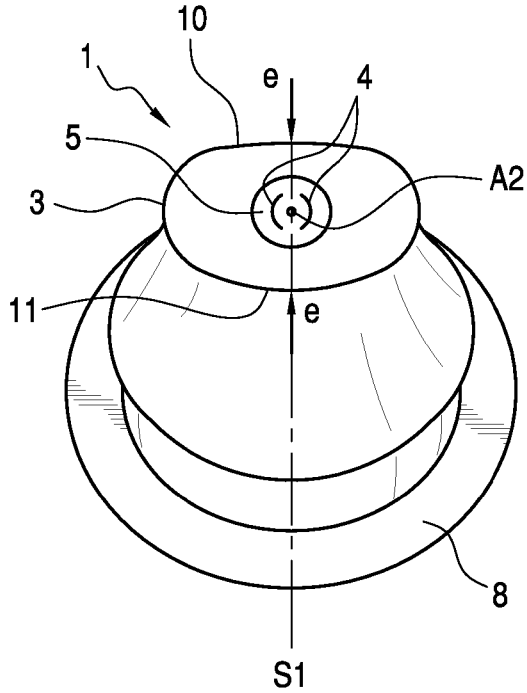
FIG. 3 shows an overhead view (in the A2 direction) of the nipple as shown in FIG. 1.

FIGS. 2 and 3 show that the nipple 1 is made orthodontic. The nipple element 3 is flattened, so that the nipple 1 can be held in the mouth of the infant only in a preferred or given position. The nipple element 3 for this purpose has flattened sides 10 and 11 to which a (bite) pressure is applied for the drinking process. During the drinking process preferably the upper jaw for example of an infant (top) can act on the side (top, while the other side is assigned to the lower jaw. The base direction which is labeled e obviously runs in the main plane of symmetry S1 of the nipple 1. As follows from FIG. 3, in the area of the front end of the nipple element 3 there is a slit arrangement with two arc-shaped slits 4 (see below, especially FIGS. 5*a* and 5*b*, for how the slits work). Furthermore, FIG. 3 shows that the recess 5 in a top view is made cylindrical. This cylinder shape is dictated by the tubular segment of the recess which is detailed below. As FIG. 2 shows, the nipple 1 is symmetrical about the plane of symmetry S1. Tapering between the nipple element 3 and the base body 9 is apparent in this view as well.

FIG. 4 shows in detail a nipple element 3. It has a recess 5 which consists essentially of a tubular section 7 which runs in the direction of the center line A2 of the nipple, and of a bottom section 6. The bottom section 6 is clearly made concavely arched (compare FIG. 1 which shows a flat bottom section). With such a bottom section 6 especially favorable no-spill properties can be achieved. Of course the recess can be made spherical such that a tubular section would be omitted. This slit arrangement is also designed to prevent an infant being able to drink only by sucking. The nipple 1 is therefore made such that the infant must perform chewing-biting movements in the drinking process.

The tubular segment 7 as shown in FIG. 4 is made essentially as a unilaterally truncated hollow cylinder with a roughly constant wall thickness. One cut is defined by the bottom section 6 and the other cut is defined by an opening on the front end of the nipple element 3. The unilaterally truncated hollow cylinder is characterized by the longest jacket side 12 (h1) and an opposite shortest jacket side 13 (h2). Good sucking and non-spill properties can be achieved especially if the height h2 of the second jacket side 13 is roughly 3 mm (or less). Instead of a hollow cylinder a conical configuration (hollow cone) would also be conceivable.

As follows from the top view of the bottom section 6, in the middle there is a slit arrangement with two slits 4. The slits 4 are made as notches through the bottom section 6 without material removal. The slits 4 run in the bite direction e, the slits being arranged mirror-inverted with reference to the axis of symmetry S1 (or main plane of symmetry). The slits 4 are clearly made circular, the middle of the respective arc lying on the axis of symmetry S2 and the arc running in the area of the middle perpendicularly to S2. As follows from FIG. 5, pressure in the bite direction e squeezes the slits together, by which a roughly half moon-shaped through opening 4' is formed. The slits 4 as shown in FIG. 5*a* would not form an exit opening under lateral pressure in the S2 direction.

It is furthermore apparent from FIG. 5*a* that the slits 4 lie on a circle with a center which is formed by the center line A2 of the nipple.

Figure 6:
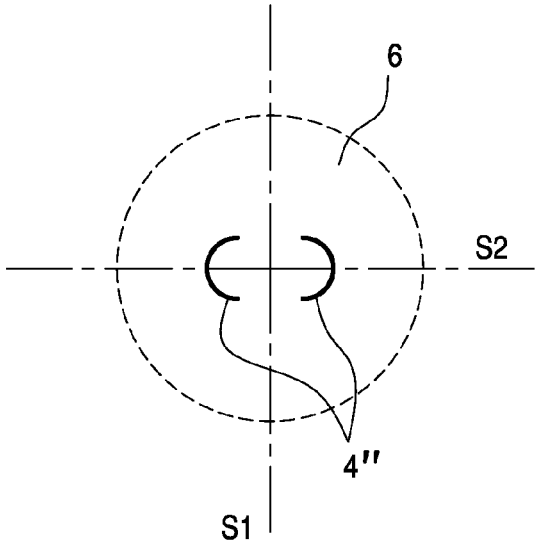
FIG. 6 shows a slit arrangement according to another exemplary embodiment.
Figure 7:
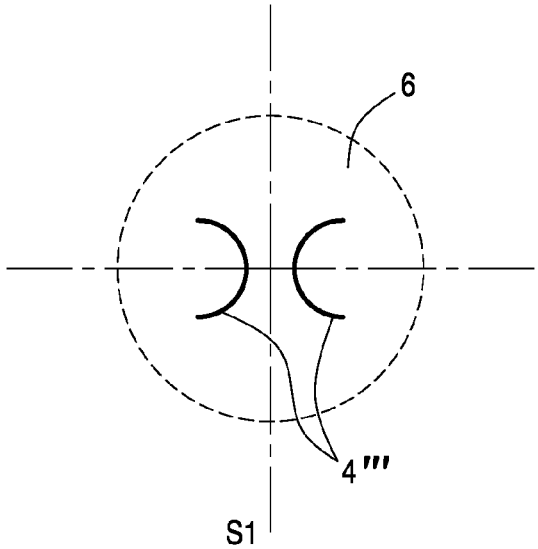
FIG. 7 shows a slit arrangement according to one alternative exemplary embodiment.
Figure 8:
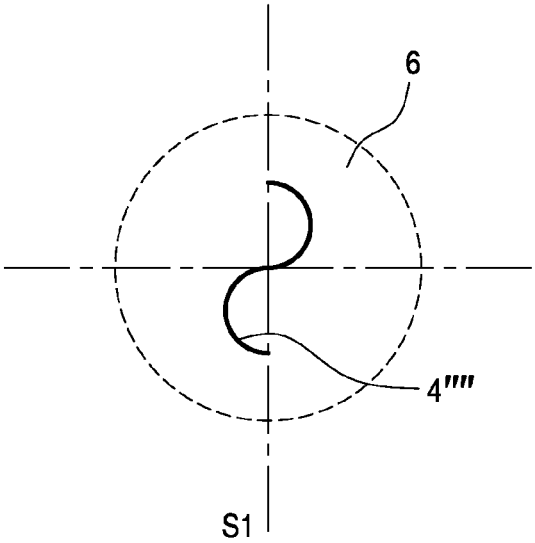
FIG. 8 shows a slit arrangement according to a fourth exemplary embodiment.

FIGS. 6 to 8 show other versions of slit arrangements. The individual slits 4" as shown in FIG. 6 each form a semicircle, the semicircles being pointed at one another. Of course however the slits 4''', as shown in FIG. 7, can be pointed away from one another. In FIG. 8 the slit arrangement consists of an individual slit 4''''. The slit 4'''' has a sine-like configuration with two semicircles. Of course however the slits could also have other shapes.

A slit should however define a curve of the second order.

Figure 9:
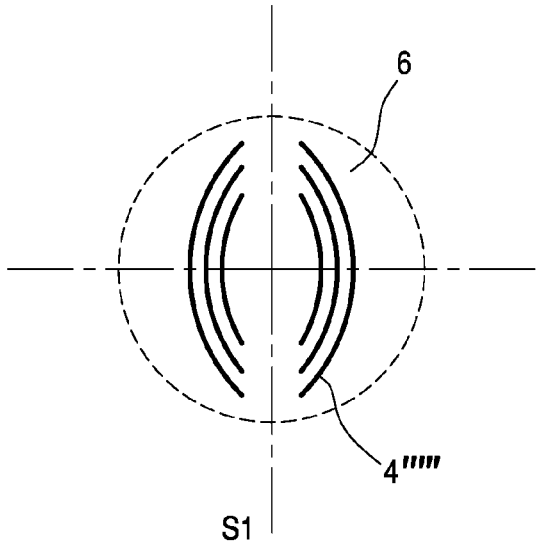
FIG. 9 shows a slit arrangement according to a fifth exemplary embodiment.

FIG. 9 shows a special configuration of a slit arrangement. Clearly it has three slits 4'''' at a time with reference to the main axis of symmetry S1; they are arranged symmetrically to one another and are pointed at one another. Three slits 4'''' at a time are arranged on concentric circles for forming a louver-like structure. Such a grouped arrangement of slits on concentric circles could of course also consist of only two slits or of a host of slits. Liquid passage can be increased with the louvered structure.

Figure 10:
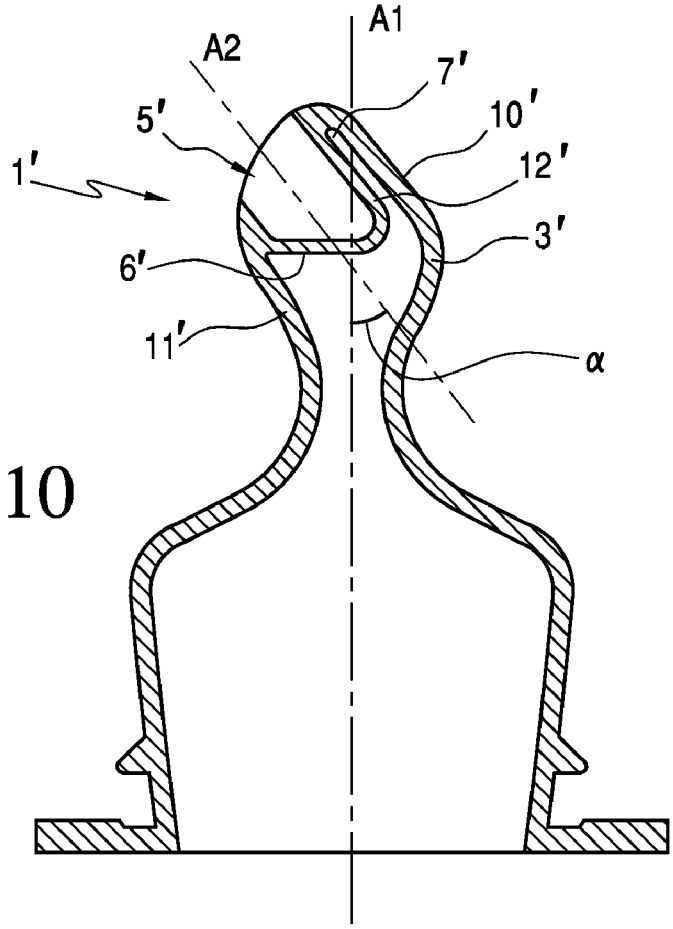
FIG. 10 shows a cross section through a nipple according to another exemplary embodiment.
Figure 11:
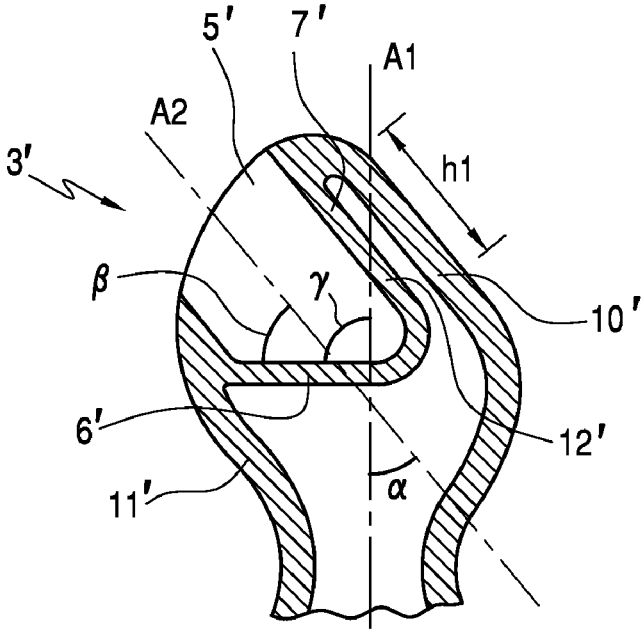
FIG. 11 shows a detailed representation of the nipple element of the nipple shown in FIG. 10.
Figure 12:
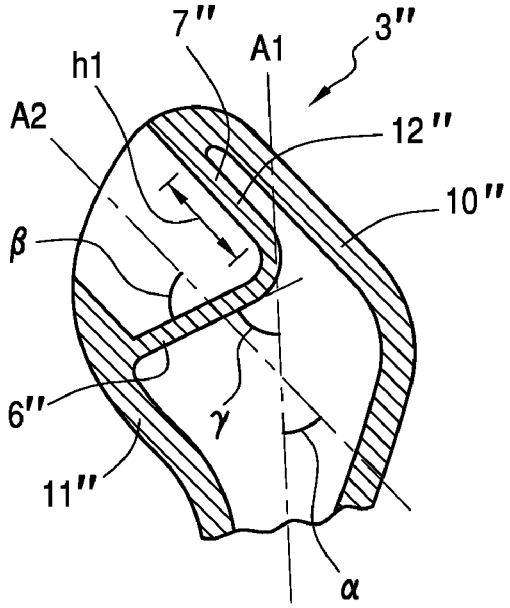
FIG. 12 shows one alternative exemplary embodiment of the nipple element as shown in FIG. 11.

As follows from FIGS. 10 and 11 as well as 12, the bottom section 6 of the recess 5 need not run perpendicular to the center line A2 of the nipple. Tests have shown that an oblique (or slanted) arrangement of the bottom section 6 can surprisingly even be advantageous. In FIGS. 10 and 11 the bottom section 6 which is made flat runs at a right angle to the principal center line A1 (i.e. $\gamma=90°$). The tilt angle $\alpha$ of the center line A2 of the nipple to the principal center line A1 is roughly 38°. The preferred range for $\alpha$ can be between 20°and 45°. In FIG. 12 the bottom section 6 is bent relative to the center line A2 of the nipple such that the tilt angle $\beta$ is roughly 70°. The tilt angle $\beta$, depending on the tilt angle $\alpha$ and the desired application, however could also be between 30° and 80°.

Figure 13:
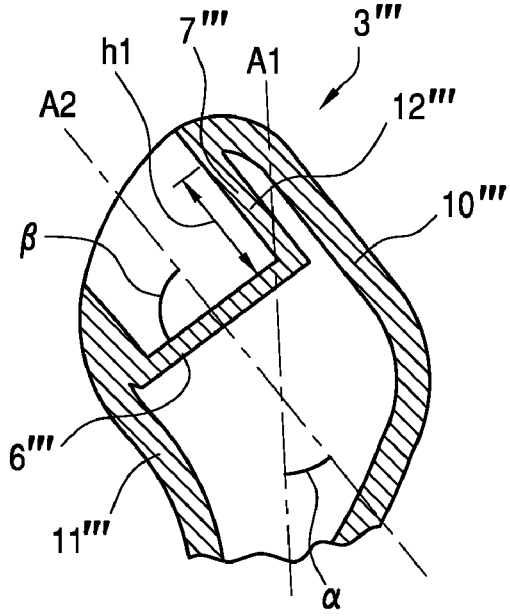
FIG. 13 shows another embodiment of the nipple element as shown in FIG. 11.

Furthermore, it is apparent from FIGS. 10 to 12 that the tubular section 7 defined in cross section by the main plane of symmetry [S1] is essentially a truncated hollow cylinder. Preferably the hollow cylinder has a roughly constant wall thickness. One cut of the truncated hollow cylinder is defined by the bottom section 6 and the other cut is defined by the opening on the front end of the nipple element 3. In this way the tubular segment 7 has the longest jacket side which is labeled 12. In the area of the side opposite the first jacket side 12 the bottom section 6 is molded directly (or without a transition) to the flattened top 11 of the nipple element 3. This transition from the bottom section 6 to the flattened top 11 especially benefits the opening behavior of the slits (4) since in this way advantageous action of force due to the bite pressure on the bottom section 6 is achieved. This leads to deformation of the bottom section 6 in the drinking process and thus to opening of the slits (4) even at a comparatively low bite pressure. This direct molding of the bottom section to the flattened side 11, the side 11 being assigned especially to the upper jaw, can of course also be used for arrangements in which the bottom section of the recess runs perpendicular to the center line of the nipple. The corresponding exemplary embodiment is shown in FIG. 13.

Figure 14:
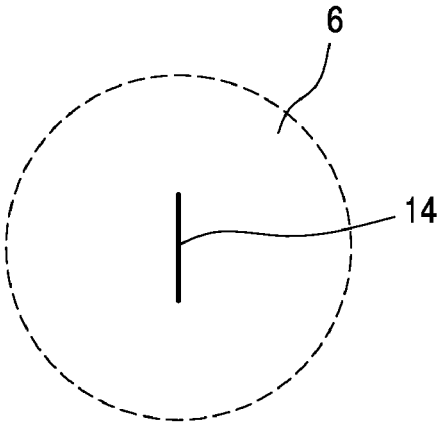
FIG. 14 shows a slit arrangement with a straight slit.
Figure 15:
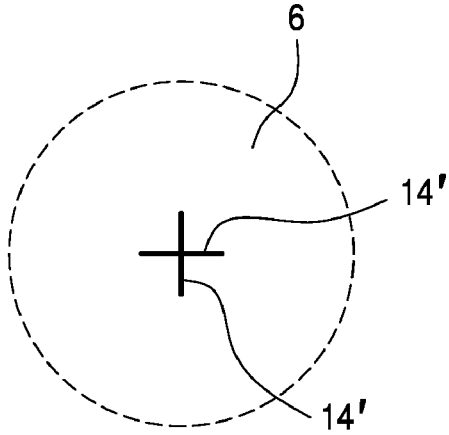
FIG. 15 shows a slit arrangement with crossing slits.

Tests with nipples have shown that in particular the configurations of the nipple element as shown in FIGS. 10 to 13 surprisingly yield advantageous results not only for slits which run in an arc shape (FIGS. 5 to 9), but also for conventional slit arrangements. Conventional slit arrangements ordinarily have straight slits as shown by FIGS. 14 and 15 (FIG. 14: I-cut; FIG. 15: X-cut).

Figure 16:
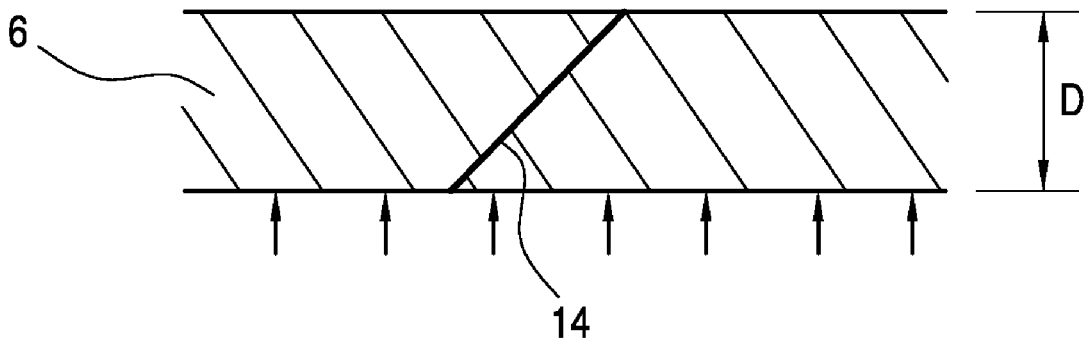
FIG. 16 shows a cross section through one wall of a nipple element with a slit.

Generally a slit runs straight through the wall of the nipple. But as follows from FIG. 16, the slit can run obliquely through the wall of the nipple element 3 (the wall thickness is labeled D).

What is claimed is:

1. A nipple for feeding or drinking bottles, said nipple being made of elastic material with a nipple element for holding in the mouth and a slit arrangement in the area of a front end of the nipple element, in the area of the front end of the nipple element there is a recess which is pointed to the inside, the slit arrangement being located in a bottom section of the recess, wherein the nipple element is flattened to fix one preferred bite direction and the slit arrangement has at least one arc-shaped slit which is closed in an unpressurized state and which opens under pressure in the bite direction, the slit running roughly in the bite direction wherein the nipple further comprises a base body on which the nipple element is adjoining, the base body defining a principal center line and the nipple element extending along a center line, wherein the center line of the nipple element is tilted by an angle $\alpha$ with reference to the principal center line.

2. A nipple as claimed in claim 1, wherein the tilt angle $\alpha$ is between 10° and 60°.

3. A nipple as claimed in claim 1, wherein the tilt angle $\alpha$ is between 20° and 45°.

4. A nipple as claimed in claim 1, wherein the tilt angle $\alpha$ is about 30°.

5. A nipple as claimed in claim 1, wherein the recess has a tubular segment which is sealed by the bottom section.

6. A nipple as claimed in claim 1, wherein the bottom section is either flat or concavely or convexly arched.

7. A nipple as claimed in claim 1, wherein the bottom section of the recess is located essentially at a right angle to the center line of the nipple element.

8. A nipple as claimed in claim 1, wherein the bottom section of the recess runs substantially at a right angle to the principal center line.

9. A nipple as claimed in claim 1, wherein the slit arrangement has two slits.

10. A nipple as claimed in claim 9, wherein the slits are arranged symmetrically with reference to a main plane of symmetry and are pointed toward one another.

11. A nipple as claimed in claim 1, wherein the slit is roughly circular.

12. A nipple as claimed in claim 9, wherein the slits lie on a circle centered on the center line of the nipple element.

13. A nipple as claimed in claim 1, wherein the nipple is symmetrical about a plane of symmetry and the slit arrangement with reference to the plane of symmetry has at least two slits which are located symmetrically about said plane of symmetry and are pointed at one another, the respective slits being arranged on concentric circles to form a louver-like structure.

14. A nipple for feeding or drinking bottles, said nipple being made of elastic material and comprising a nipple element for holding in the mouth and a slit arrangement in a front end of the nipple element, wherein the nipple element is flattened to fix one preferred bite direction, a recess formed in the area of the front end of the nipple element, the slit arrangement being located in the recess, the recess having a tubular segment which is sealed by a bottom section, wherein the tubular segment is essentially a truncated hollow cylinder with a roughly constant wall thickness, the truncated cylinder extending along an axis inclined with respect to a principal axis of the nipple, one end of the truncated cylinder being defined by the bottom section and the other end of the truncated cylinder being defined by an opening on the front end of the nipple element, wherein the nipple is symmetrical about a main plane of symmetry, and wherein the tubular segment defined in cross section by the main plane of symmetry forms a first, longer jacket side, and an opposing second, shorter jacket side, the height of said second jacket side being less than 3 mm.

15. A nipple as claimed in claim 14, wherein the height of the second jacket side is less than 1 mm.

16. A nipple for feeding or drinking bottles, said nipple being made of elastic material and comprising a nipple element for holding in the mouth and a slit arrangement in a front end of the nipple element, wherein the nipple element is flattened to fix one preferred bite direction, a recess formed in the area of the front end of the nipple element, the slit arrangement being located in the recess, the recess having a tubular segment which is sealed by a bottom section, wherein the tubular segment is essentially a truncated hollow cylinder with a roughly constant wall thickness, the truncated cylinder extending along an axis inclined with respect to a principal axis of the nipple, one end of the truncated cylinder being defined by the bottom section and the other end of the truncated cylinder being defined by an opening on the front end of the nipple element, wherein the nipple is symmetrical about a plane of symmetry, wherein a cross section of the tubular segment taken on said plane of symmetry has a longer jacket side and a shorter jacket side, and wherein the bottom section in the area of the shorter jacket side is molded directly to the flattened top of the nipple element.

17. A nipple for feeding or drinking bottles, said nipple being made of elastic material with a base body and a nipple element for holding in the mouth adjoining the base body, the base body defining a principal center line and the nipple element extending along a center line, and a slit arrangement in the area of the front end of the nipple element, where the nipple element is flattened to fix one preferred bite direction, in the area of the front end of the nipple element there is a recess which is pointed to the inside, the slit arrangement being located in the recess, wherein the center line of the nipple element is tilted at an angle $\alpha$ relative to the principal center line and wherein the recess has a bottom section which is bent relative to the center line of the nipple element such that there is a tilt angle $\beta 0$ between 30° and 80°.

* * * * *